US006296038B1

(12) United States Patent
Chen

(10) Patent No.: US 6,296,038 B1
(45) Date of Patent: Oct. 2, 2001

(54) SLIDING DOOR PANEL RETAINING DEVICE

(76) Inventor: Chang Than Chen, 12F, No. 426, Ming Chuan 2nd Road, Chien Chen Chu, Kaohsiung (TW)

( * ) Notice: Subject to any disclaimer, the term of this patent is extended or adjusted under 35 U.S.C. 154(b) by 0 days.

(21) Appl. No.: 09/472,273

(22) Filed: Dec. 27, 1999

(51) Int. Cl.[7] ..... E05D 15/26

(52) U.S. Cl. ..... 160/199; 160/118; 160/40; 52/71

(58) Field of Search ..... 52/70, 71; 160/118, 160/199, 196.1, 206, 213, 231.1, 231.2, 40, 35, 84.09, 84.11; 49/377, 440, 441; 292/341.17, 303, 341.15

(56) References Cited

U.S. PATENT DOCUMENTS 3,799,237 * 3/1974 Proserpi ..... 160/199
5,301,735 * 4/1994 Chen ..... 160/199
5,503,700 * 4/1996 Dupuy ..... 156/245
5,690,157 * 11/1997 Chen ..... 160/199

* cited by examiner

*Primary Examiner*—Carl D. Friedman
*Assistant Examiner*—L. Bennett Porterie, Jr.
(74) *Attorney, Agent, or Firm*—Charles E. Baxley

(57) ABSTRACT

A sliding door assembly includes a number of door panels slidably engaged with a track and a leader end secured to one end of the door panels. A retaining device forms a channel for receiving the leader end and has a pair of opposite resilient stops trapezoidal in cross-section and extended inwardly into the channel for engaging with the leader end and for retaining the leader end within the retaining device. The retaining device may be secured to a supporting abutment, usually a wall member, or may be secured to and moved in concert with the leader member of another sliding door subassembly for coupling the sliding door subassemblies together.

1 Claim, 8 Drawing Sheets

SLIDING DOOR PANEL RETAINING DEVICE

BACKGROUND OF THE INVENTION

1. Field of the Invention

The present invention relates to a sliding door, and more particularly to a sliding door having a retaining device for retaining the door panel in place.

2. Description of the Prior Art

Typical sliding doors (FIGS. 5–7) include a number of door panels 10 slidably coupled to an upper track 12 with wheels or rollers 11 and include a free end portion having a beam 13 secured to the door panels 10. A retaining device 15 is secured to a supporting wall or door frame 80, or may be secured to the end beam 13 of the other sliding door (FIG. 8). The retaining device 15 and the end beam 13 each has one or more magnetic devices 16, 17 engaged therein for attracting with each other and for securing the end beam 13 to the retaining device 15. A handle 14 is attached to the end beam 13 for moving the door panels 10 and for moving the beam 13 toward and away from the retaining device 15. However, the retaining device 15 and the beam 13 are required to be excavated with a number of holes for engaging the magnetic devices 16, 17 into the holes of the retaining device 15 and the beam 13 respectively.

The present invention has arisen to mitigate and/or obviate the afore-described disadvantages of the conventional sliding doors.

SUMMARY OF THE INVENTION

The primary objective of the present invention is to provide a sliding door having a retaining device for retaining the door panel in place.

In accordance with one aspect of the invention. there is provided a sliding door assembly comprising a a first sliding door device including a plurality of door panels slidably coupled to a track and including an end beam, and a retaining device including a channel for receiving the beam, and the retaining device including a pair of opposite resilient stops extended inward of the channel and extended toward each other and each having a free end portion, the channel of the retaining device including a size greater than that of the beam for receiving the beam in the channel, a distance between the free end portions of the resilient stops being smaller than that of the beam for allowing the resilient stops to engage with and to retain the beam within the retaining device.

The retaining device is secured to a supporting member. A handle is secured to the beam for moving the beam toward and away from the retaining device.

A second sliding door device is further provided and includes a plurality of door panels slidably coupled to the track and movable along the track, the second sliding door device includes a first end having a beam provided thereon, and means for securing the retaining device to the beam of the second sliding door device. The retaining device includes a recess formed therein and opposite to the channel of the retaining device for receiving the beam.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
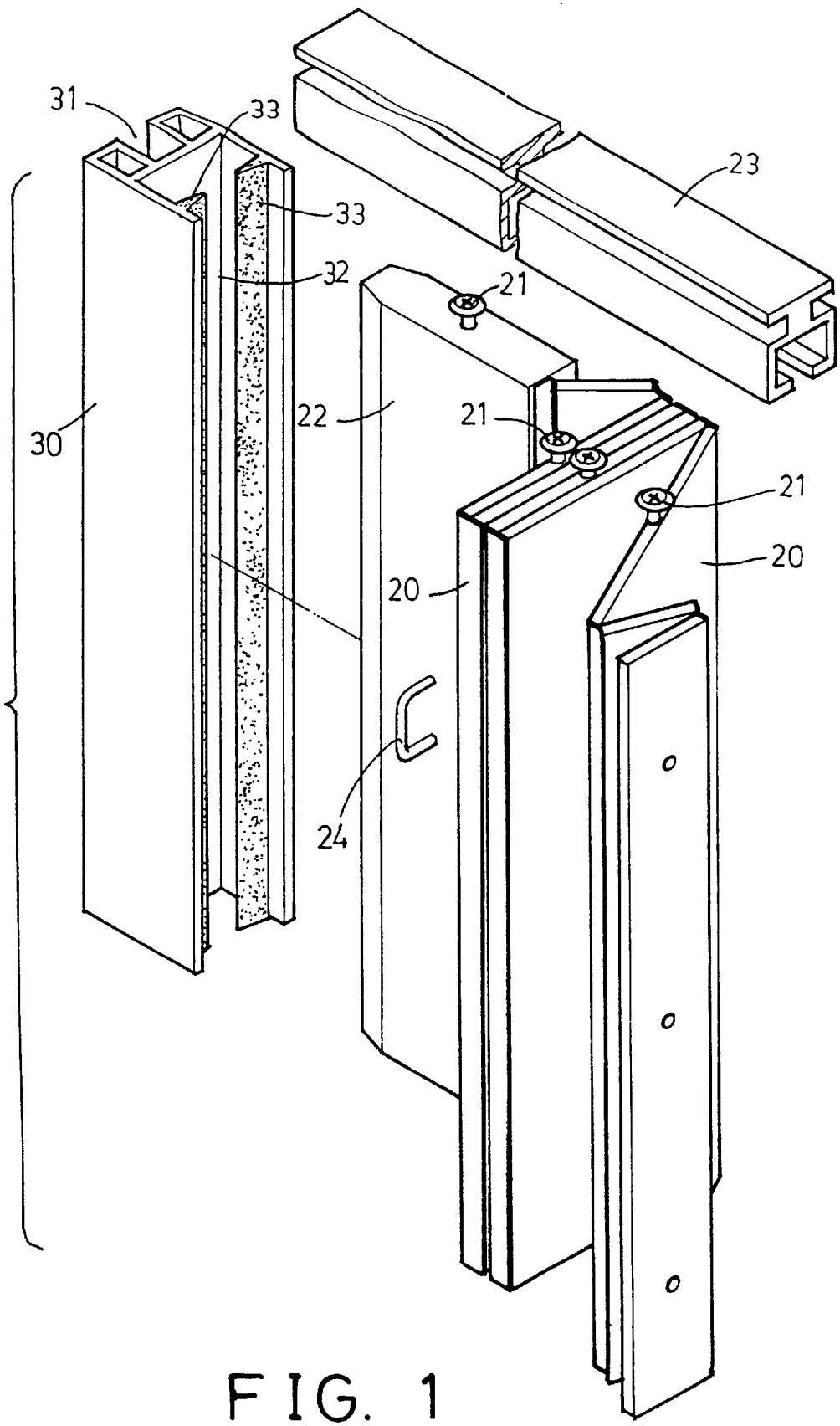
FIG. 1 is an exploded view of a sliding door in accordance with the present invention.
Figure 2:
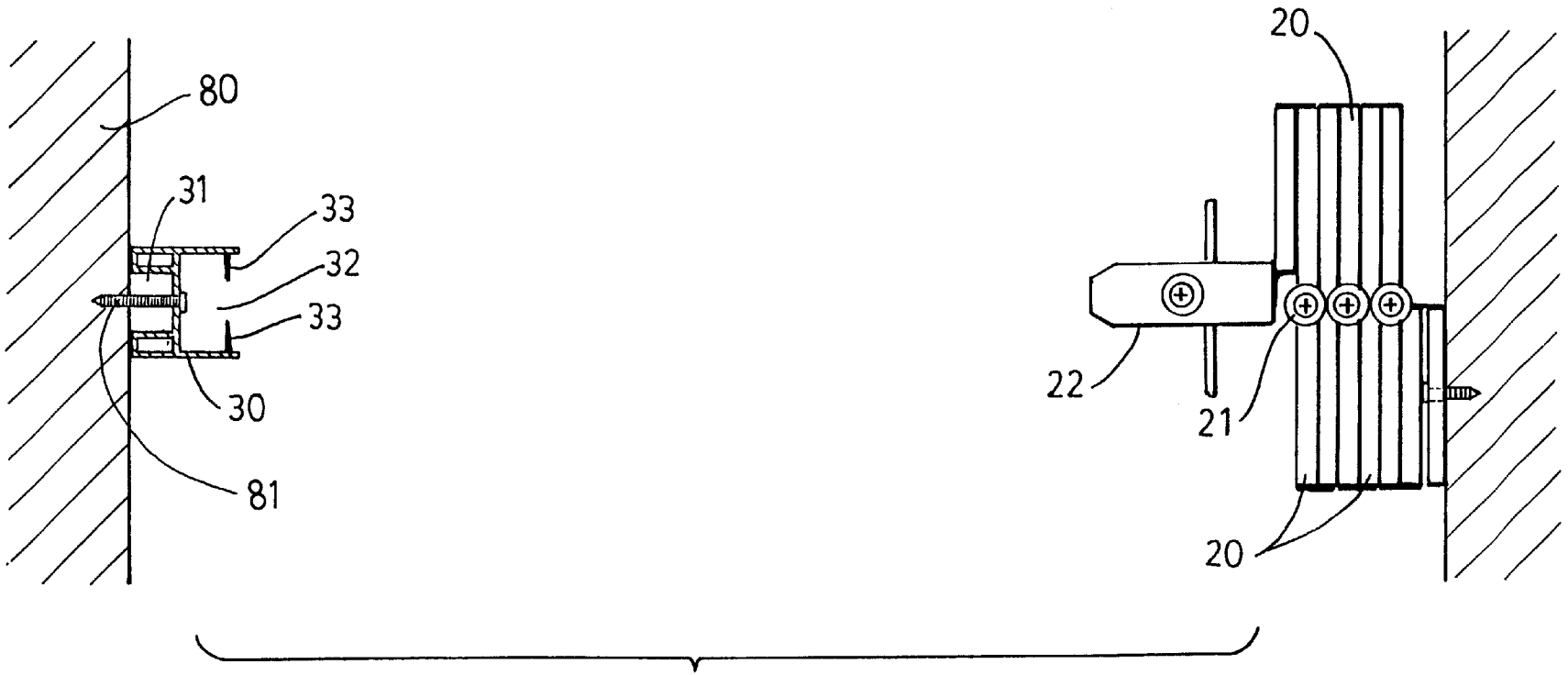
FIGS. 2 and 3 are cross sectional views illustrating the operation of the sliding door.
Figure 3:
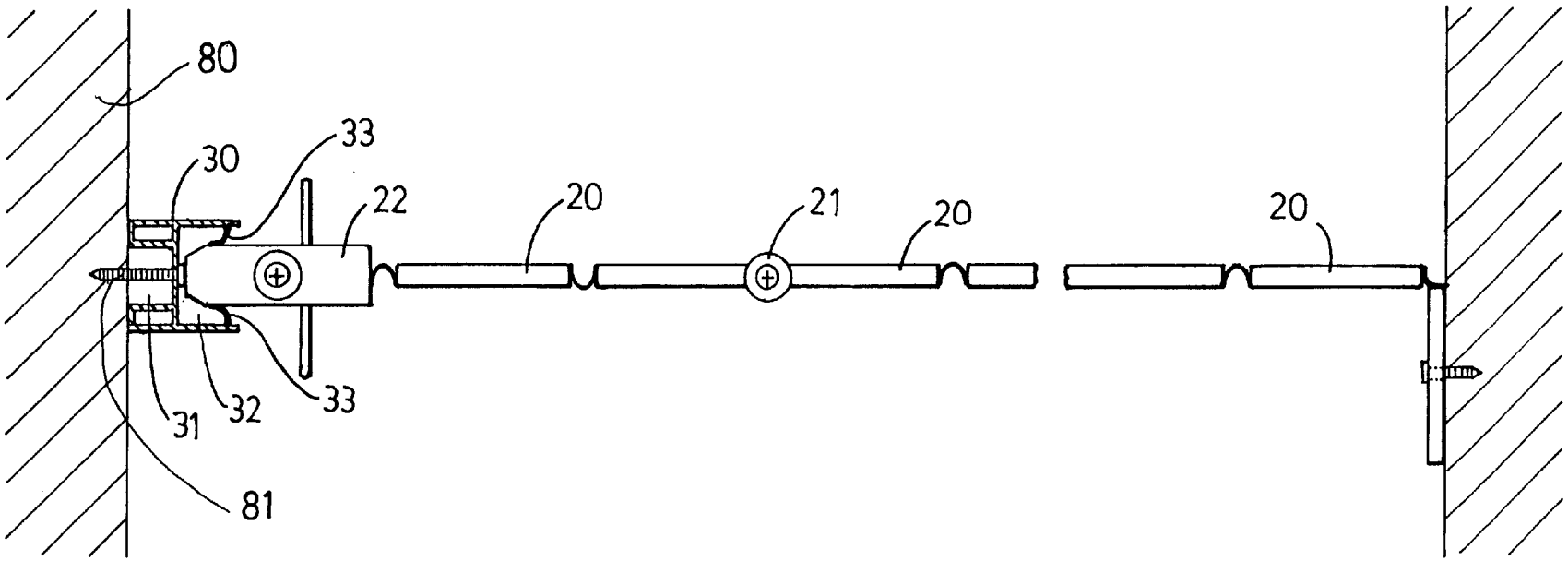

Referring to the drawings, and initially to FIGS. 1–3, a sliding door assembly in accordance with the resent invention comprises a sliding door device including a number of door panels 20 slidably coupled to an upper track 23 with wheels or rollers 21 and including a free end portion having a beam 22 secured to the door panels 20 and slidably coupled to the upper track 23 with a wheel or roller 21. A handle 24 is attached to the beam 22 for moving the door panels 20 and for moving the beam 22 toward and away from a door panel retaining device 30.

A retaining device 30 may be secured to a supporting member 80, such as a supporting wall or a door frame, with fasteners 81 (FIGS. 2, 3) and includes a first end portion having a recess 31 formed therein and includes a second end portion having a channel 32 formed therein for receiving the beam 22 of the sliding door device. As best shown in FIG. 3, the channel 32 includes a size larger than that of the beam 22 for receiving the beam 22 in the channel 32. The retaining device 30 includes a pair of opposite flexible or resilient stops 33 extended inward of the channel 32 and extended toward each other for engaging with the beam 22 and for resiliently retaining the beam 22 within the retaining device 30. The distance between the free ends of the flexible or resilient stops 33 is smaller than that of the beam 22 such that the resilient stops 33 may be deformed to apply a resilient retaining force against the beam 22 in order to resiliently clamping the beam 22 within the retaining device 30.

Figure 4:
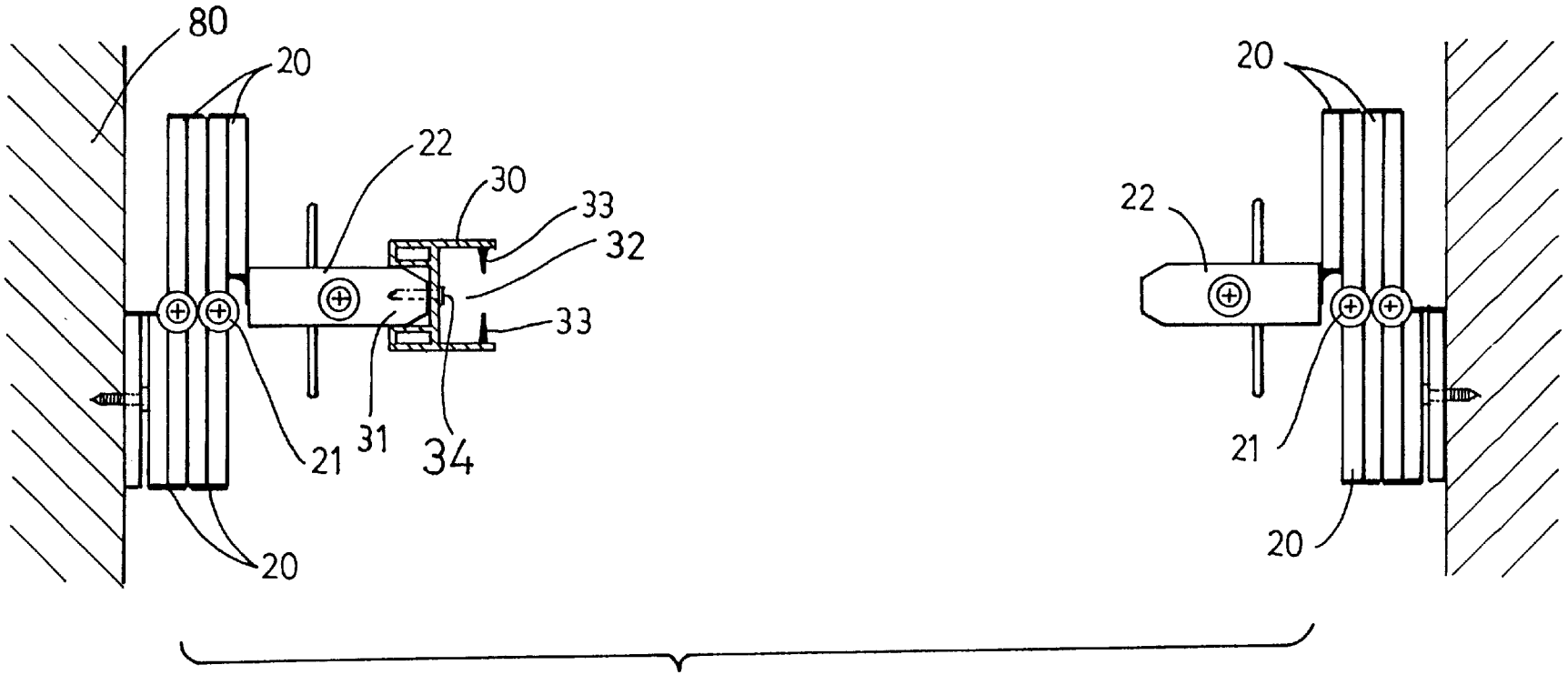
FIG. 4 is a cross sectional view similar to FIG. 2, illustrating the other application of the sliding door.
Figure 5:
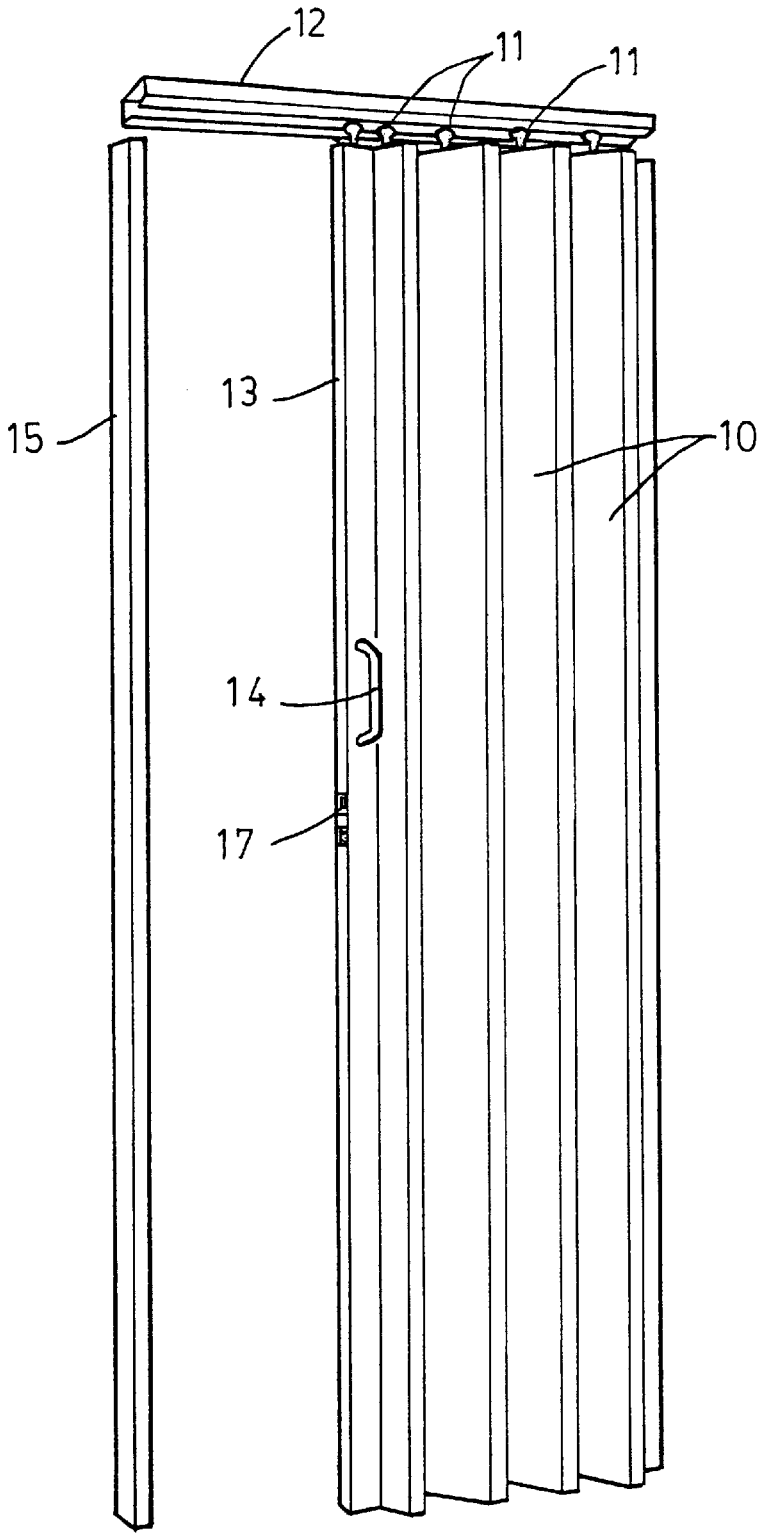
FIG. 5 PRIOR ART
FIG. 5 is a perspective view illustrating a typical sliding door.
Figure 6:
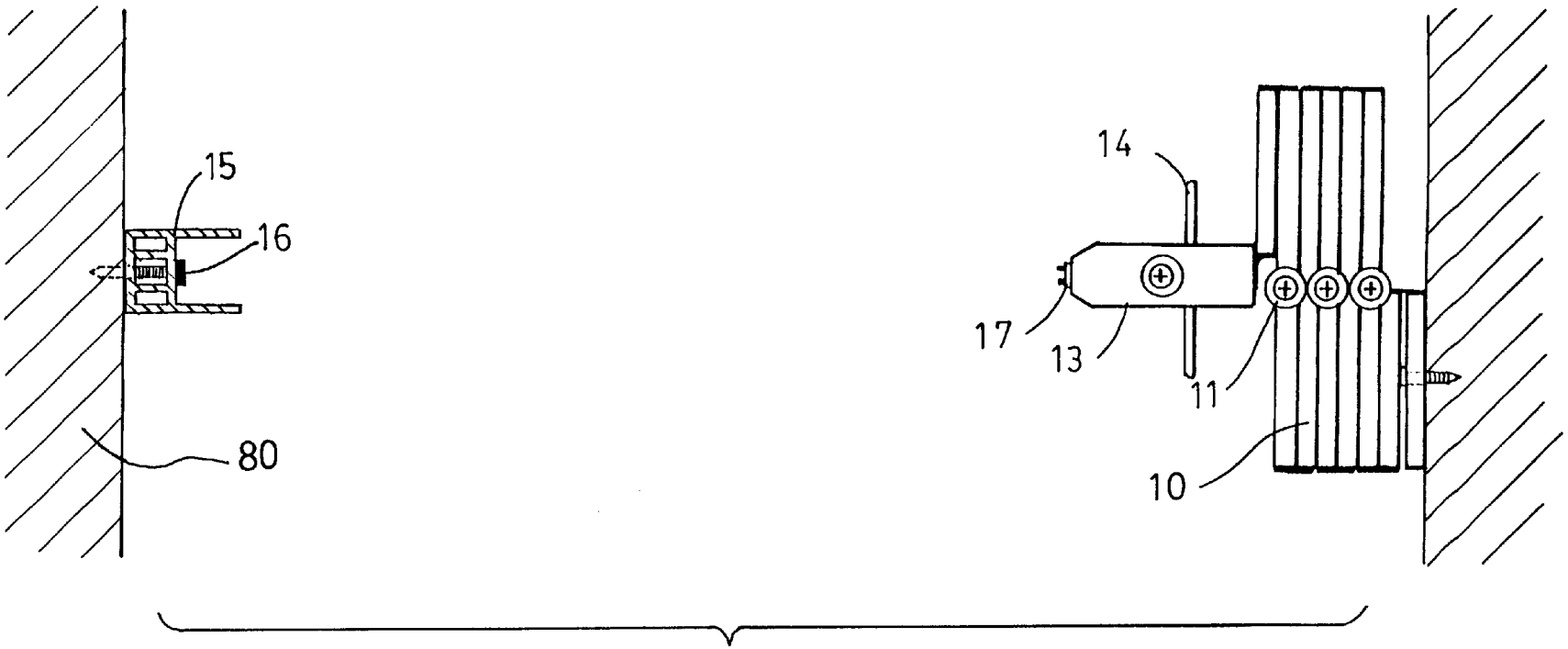
FIG. 6 PRIOR ART
FIGS. 6 and 7 are cross sectional views illustrating the operation of the typical sliding door as shown in FIG. 5.
Figure 7:
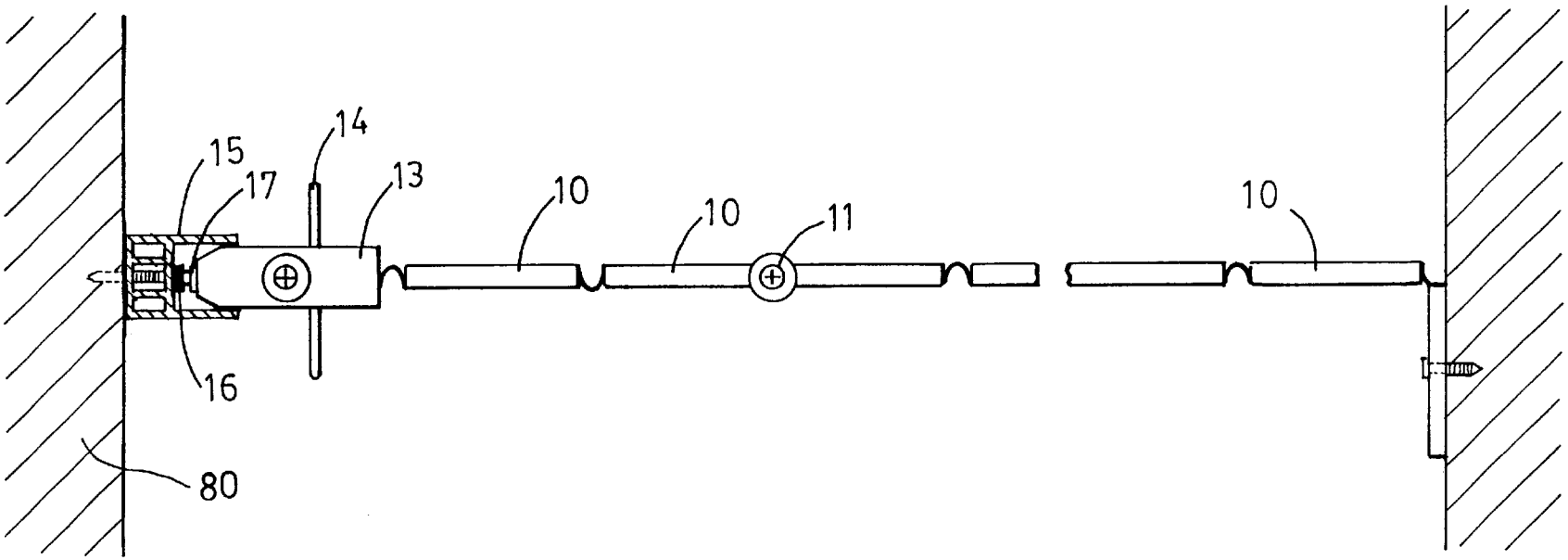
FIG. 7 PRIOR ART
Figure 8:
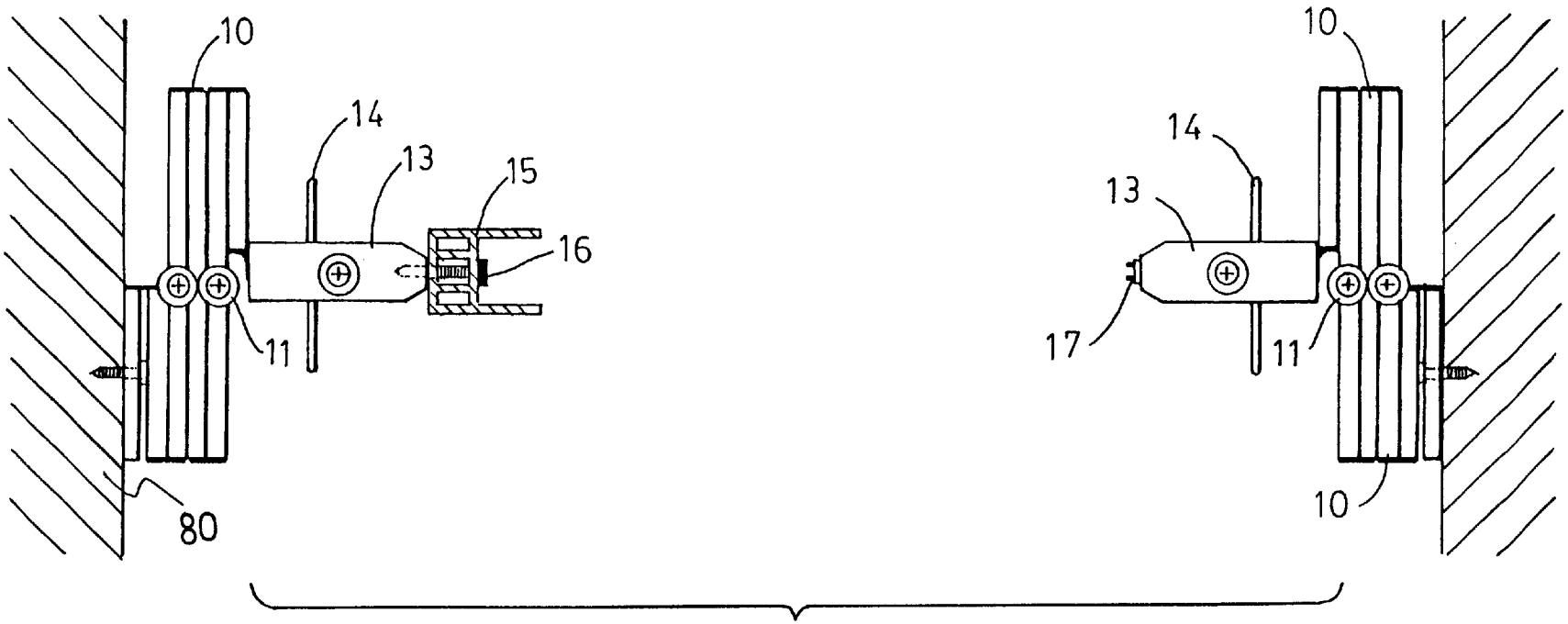
FIG. 8 PRIOR ART
FIG. 8 is a cross sectional view similar to FIGS. 5–7, illustrating the other typical sliding door.

Referring next to FIG. 4, the sliding door assembly includes a sliding door device provided on the left portion and having the left end secured to the supporting member 80 and also having a beam 22. The recess 31 of the retaining device 30 may receive the beam 22, and the retaining device 30 may be secured to the beam 22 with fasteners 34, such that the retaining device 30 moves in concert with the beam 22. The beam 22 of the sliding door device as shown in the right portion of FIG. 4 also may be engaged into the channel 32 of the retaining device 30 and may be clamped to the retaining device 30 with the flexible or resilient stops 33.

Accordingly, the sliding door in accordance with the present invention includes a retaining device which may be used for retaining the door panel in place to the supporting member or or may be used for coupling two sliding door device together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sliding door assembly comprising:

a track, a first sliding door assembly including a plurality of first door panels all of substantially the same length as each other and all connected in a series and each slidably retained by the track and movable along the track;

the first sliding door assembly including a first end having a leader member provided thereon, the leader member substantially coextensive in length with the door panels and the leader member having a straight beveled front face and a rearwardly diverging truncated leader width;

a retaining means including a channel having two legs for receiving the leader member between the legs, said retaining means including a pair of opposite resilient stops, each of the stops projecting from an associated one of the legs into the channel toward each other;

each of the stops having planar sides tapered from a thicker proximal end at the stop's associated leg to a thinner distal end toward the other stop;

the distal ends of each of the stops spaced apart from each other to define a stop width which is smaller than the leader width for allowing the stops to engage with and to retain the leader member by the retaining means.

* * * * *